252-102 AU 166 EX
4/25/78 XR 4,086,176

United States Patent [19] [11] 4,086,176
Ericson et al. [45] Apr. 25, 1978

[54] SOLUTIONS FOR CHEMICALLY POLISHING SURFACES OF COPPER AND ITS ALLOYS

[75] Inventors: Harry Ericson, Vastra Frolunda; Carl Otto Fredriksson, Goteborg, both of Sweden

[73] Assignee: Nordnero AB, Kungalv, Sweden

[21] Appl. No.: 638,698

[22] Filed: Dec. 8, 1975

[30] Foreign Application Priority Data

Dec. 13, 1974 Sweden ..... 7415649

[51] Int. Cl.[2] ..... C23F 3/00; C23G 1/06; C09K 13/06; C11D 7/08

[52] U.S. Cl. ..... 252/100; 134/3; 134/41; 156/666; 156/903; 252/79.2; 252/79.4; 252/102; 252/142; 423/272

[58] Field of Search ..... 252/100, 87, 102, 85, 252/142, 148, 79.2, 79.4, 548; 134/3, 41; 156/18, 20, 666, 903; 423/272

[56] References Cited

U.S. PATENT DOCUMENTS

| | | | |
|---|---|---|---|
| 2,211,400 | 8/1940 | Wood | 252/100 X |
| 2,428,804 | 10/1947 | Terry | 252/100 |
| 2,894,905 | 7/1959 | Bernard | 252/148 X |
| 3,194,768 | 7/1965 | Lindner et al. | 252/100 X |
| 3,345,217 | 10/1967 | Wollgien et al. | 134/3 X |
| 3,367,875 | 2/1968 | Sherer et al. | 252/79.4 |
| 3,537,926 | 11/1970 | Fischer | 252/79.4 X |
| 3,709,824 | 1/1973 | Oda et al. | 252/142 |
| 3,770,530 | 11/1973 | Fujimoto | 252/79.4 X |
| 3,773,577 | 11/1973 | Shibasaki et al. | 156/18 X |
| 3,869,401 | 3/1975 | Ernst | 423/272 X |
| 3,905,907 | 9/1975 | Shiga | 134/3 X |
| 3,948,703 | 4/1976 | Kushibe | 156/20 |

FOREIGN PATENT DOCUMENTS

| | | |
|---|---|---|
| 1,317,445 | 5/1973 | United Kingdom. |

*Primary Examiner*—Harris A. Pitlick
*Attorney, Agent, or Firm*—Charles A. Laff; J. Warren Whitesel; Howard B. Rockman

[57] ABSTRACT

A solution for chemically polishing surfaces of copper and its alloys contains acid oxalates at a pH value of 3.0 - 5.0 in combination with hydrogen peroxide and one or more stabilizers and brighteners.

2 Claims, 1 Drawing Figure

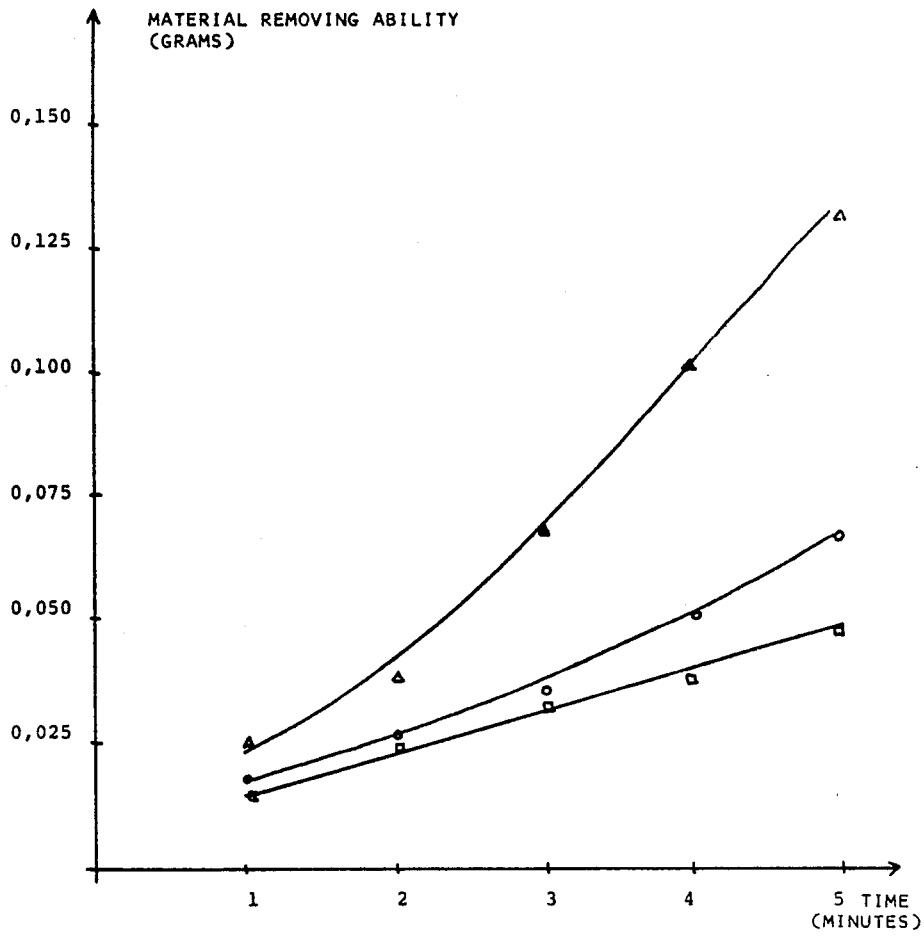
△ = 60°C
○ = 50°C
□ = 40°C
REMOVING TESTS USING BRASS MATERIAL
SURFACE: 1 $DM^2$

SOLUTIONS FOR CHEMICALLY POLISHING SURFACES OF COPPER AND ITS ALLOYS

The present invention relates to solutions for chemically polishing surfaces of metal, especially metals such as copper and its alloys.

Copper and brass are generally polished in mineral acid mixtures containing nitric acid in high concentrations which is, so called "bright dip". Such a solution may have the following composition:

| | |
|---|---|
| Sulphuric acid (conc.) | 450 ml |
| Nitric acid | 250 ml |
| Chlorhydric acid | 5 ml |
| Water up to | 1000 ml |

This solution has several disadvantages, such as (1) generation of nitrous gases with the occupational hygiene problems connected thereto, (2) substantial material removal from the metal surface treated and a rapid consumption of the solution, (3) rinsing difficulties and also difficulties in treatment of the rinsing water, (4) substantially exothermic pickling reaction and cooling mostly necessary, (5) short treatment times are accompanied after-pickling effects, when articles are transported from the pickling solution to the rinsing baths, resulting in an uneven pickling, (For that reason, it is very difficult to automate the process), (6) extremely corrosive, and (7) an effective ventilation necessary.

In those cases where a satin-finish is sufficient, a bichromate-sulphuric acid solution has been used. The use of such a solution means that no poisonous gases are generated, but a natural consequence is that problems arise in removing the pollutants from the rinsing water.

In recent years, hydrogen peroxide has also been used as a bright dip, as is revealed through the British Pat. No. 1,164,347. The disadvantage noted here is a high concentration of hydrogen peroxide, about 15%, which gives a very corrosive solution with a high consumption of peroxide, resulting in a short life of the solution and a poor economy.

Through the present invention, these disadvantages have been completely eliminated. Thus, the invention makes it possible to provide a solution giving a high polish or brightening effect to copper and brass surfaces, by using low-concentrated salt solutions with a moderate degree of acidness (pH 4).

According to the invention, the solution contains acid oxalates at a pH value of 3.0 – 5.0, together with hydrogen peroxide and one or more stabilisers and brighteners.

The inventive solution has pronounced occupational hygienic advantages, since it is non-corrosive and does not generate any poisonous gases.

The solution contains acid alkali oxalates as a base component, except hydrogen peroxide. It is known to use oxalic acid in combination with hydrogen peroxide to produce a bright surface on iron. These solutions, however, have no brightening effect on metal surfaces, such as copper and its alloys. Furthermore, it has been proven that the stability of the hydrogen peroxide rapidly decreases with lower pH values.

The solution, according to the invention, may contain a mixture of potassium or sodium oxalate and potassium or sodium binoxalate. The concentration is about 20 – 30 g/l. The ratio between oxalate and binoxalate is such that a pH value of about 4 is provided.

The bath is normally started from sodium oxalate and oxalic acid. The concentration of hydrogen peroxide normally varies between 10 g/l and 50 g/l of a 35% commercial product. Normal operating temperature of the bath is about 50° C. The hydrogen peroxide is very stable at temperatures up to 70° C and only a small segregation and consumption has been observed.

As additional stabilising means, tensides are used which consist of tertiary fatty amines of the general formula:

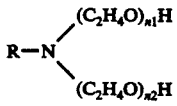

in which R is an aliphatic carbon chain consisting of 24 carbon atoms. Such an addition of a tenside gives an improved stability of the hydrogen peroxide, a more rapid pickling acton, and a more uniform result.

When the above mentioned tensides are used as an addition agent, they are preferably combined with substituted triazoles, preferably benzotriazoles. The triazoles may be used alone without combination with fatty amines, as the triazoles in themselves have a stabilising effect on the pickling process.

It has been observed that the brightening effect of the bath can be still more improved by addition of sodium lignine sulphonate.

The invention will be better understood through the following Examples:

EXAMPLE 1

| | |
|---|---|
| Oxalic acid | 10 g/l |
| Calcined sodium carbonate | 5 g/l |
| Hydrogen peroxide 35 % | 20 g/l |
| Benzotriazol | 0.5 g/l |
| pH adjusted to | 3.5 |
| Operating temperature | 50° C |

| | |
|---|---|
| Example 2 | |
| Oxalic acid | 6 g/l |
| Disodium oxalate | 19 g/l |
| Hydrogen peroxide 35 % | 50 g/l |
| Tenside with the general formula 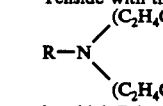 in which R is an aliphatic carbon chain with 18 carbon atoms and n = 12 | 0.1 g/l |
| Benzotriazole | 0.1 g/l |
| Lignin sulphonate | 0.5 g/l |
| pH adjusted to | 3.9 |
| Operating temperature | 40 – 60° C |

| | |
|---|---|
| Example 3 | |
| Oxalic acid | 40 g/l |
| Hydrogen peroxide 35 % | 50 g/l |
| Tenside according to Example 2 | 0.05 g/l |
| Benzotriazole | 0.5 g/l |
| pH adjusted with potassium hydroxide to | 4.1 |

-continued

| | |
|---|---|
| Operating temperature | 45° C |

| | |
|---|---|
| Example 4 | |
| Oxalic acid | 4 g/l |
| Disodium oxalate | 13 g/l |
| Hydrogen peroxide 35 % | 75 g/l |
| Benzotriazole | 0.08 g/l |
| Lignin sulphonate | 1.5 g/l |
| pH adjusted to | 3.7 |
| Operating temperature | 55° C |

With the solution according to Example 2, tests of the material removing ability were made, the results of which are presented on the attached figure of the drawing.

During the pickling, relatively difficultly soluble metal oxalates are obtained. These are crystallized by cooling the bath to room temperature. They can then be separated through decanting or filtration. The crystals can then be burned, giving as end product a mixture of zinc and copper oxides. Thus, the bath is continously regeneratable by adding sodium oxalate and/or oxalic acid, so that the pH value is maintained constant.

We claim:

1. A solution for chemically polishing surfaces of copper and its alloys which contains mono- and/or di-substituted alkali metal salts of oxalic acid at a pH value of 3.0 - 5.0 in combination with hydrogen peroxide, at least one stabilizer to stabilize the hydrogen peroxide, said stabilizer being selected from the group consisting of an aliphatic fatty amine of the formula $$C_{18}H_{37}-N\begin{matrix}(C_2H_4O)_{12}H\\(C_2H_4O)_{12}H\end{matrix}$$

and benzotriazole, and at least one brightener consisting of 0.1 - 5.0 g/l sodium lignin sulphonate.

2. A process for chemically polishing surfaces of cooper and its alloys comprising introducing the surfaces in a solution containing a mixture of mono- and/or di-substituted alkali metal salts of oxalic acid such that a pH value of 3.0 - 5.0 is maintained, wherein the mixture of oxalates comprises alkali metal oxalates, and alkali metal binoxalates, hydrogen peroxide, at least one stabilizer selected from the group consisting of an aliphatic fatty amine of the formula $$C_{18}H_{37}-N\begin{matrix}(C_2H_4O)_{12}H\\(C_2H_4O)_{12}H\end{matrix}$$

and benzotriazole, and at least one brightener in which the brightener consists of sodium lignin sulphonate.

* * * * *